US012656053B2

(12) United States Patent
Foster

(10) Patent No.: US 12,656,053 B2
(45) Date of Patent: Jun. 16, 2026

(54) REFRIGERATOR APPLIANCE AND METHOD OF OPERATING THE SAME DURING A VACATION MODE

(71) Applicant: Haier US Appliance Solutions, Inc., Wilmington, DE (US)

(72) Inventor: Ronald Gary Foster, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 125 days.

(21) Appl. No.: 18/647,526

(22) Filed: Apr. 26, 2024

(65) Prior Publication Data

US 2025/0334328 A1 Oct. 30, 2025

(51) Int. Cl.
*F25D 29/00* (2006.01)

(52) U.S. Cl.
CPC ..... *F25D 29/008* (2013.01); *F25D 2600/00* (2013.01); *F25D 2700/12* (2013.01)

(58) Field of Classification Search
CPC . F25D 29/008; F25D 2600/00; F25D 2700/12
See application file for complete search history.

(56) References Cited

U.S. PATENT DOCUMENTS

| | | | | |
|---|---|---|---|---|
| 9,501,782 | B2 | 11/2016 | Felgate et al. | |
| 2003/0010045 | A1 | 1/2003 | Ferragut et al. | |
| 2003/0156034 | A1 | 8/2003 | Longobardi | |
| 2009/0103587 | A1 | 4/2009 | Cooper et al. | |
| 2011/0215919 | A1* | 9/2011 | Hernandez | G08B 21/00 340/521 |
| 2012/0047919 | A1* | 3/2012 | Besore | F25D 21/04 62/498 |
| 2020/0224961 | A1* | 7/2020 | Dalmolin | F25B 49/005 |
| 2022/0049895 | A1* | 2/2022 | Oh | G05D 23/1902 |

* cited by examiner

*Primary Examiner* — Marc E Norman
(74) *Attorney, Agent, or Firm* — Dority & Manning, P.A.

(57) ABSTRACT

A refrigerator appliance includes a cabinet; at least one sensor positioned within the cabinet; and a controller operably coupled with the at least one sensor and configured to perform an operation including determining the refrigerator appliance is operating according to a predetermined operating mode; receiving a temperature signal from the at least one sensor; determining that a value of the temperature signal is outside of a predetermined threshold temperature range; determining that the temperature signal is received outside of a defrost phase during the predetermined operating mode; and emitting an alert in response to determining that the temperature signal is outside of the defrost phase and the value of the temperature signal is outside of the predetermined threshold temperature range, the alert including a value of the temperature signal and a date on which the temperature signal was received.

16 Claims, 4 Drawing Sheets

REFRIGERATOR APPLIANCE AND METHOD OF OPERATING THE SAME DURING A VACATION MODE

FIELD OF THE INVENTION

The present subject matter relates generally to domestic appliances, and more particularly to monitoring temperatures within refrigerator appliances.

BACKGROUND OF THE INVENTION

Refrigerator appliances typically include a cabinet forming one or more chilled chambers in which perishable items such as food, drinks, medications, and the like may be maintained at a temperature below ambient. Conventionally, refrigerator appliances are connected to power sources, such as municipal power sources to selectively or routinely drive a conditioning system such as a refrigeration system and an air flow system. Power is supplied to, for instance, a compressor to compress a refrigerant and circulate the refrigerant through an evaporator, an expansion device, and a condenser. Power is also supplied to a fan to circulate air over the evaporator to cool the air before supplying the air to the chilled chamber.

Refrigerator appliances are prevalent within domestic households. In these households, power supply may be interrupted at times, for instance during blackouts or power outages due to storms or the like. When power is lost, the refrigeration system may be interrupted for an extended period of time. Current refrigerator appliances exhibit drawbacks related to dealing with power outages. For instance, when a user is away for an extended period of time, such as a vacation, the user may be unaware of a duration of the power outage. Moreover, the user may be unaware of a temperature rise within the chilled chamber.

Accordingly, a refrigerator appliance which obviates one or more of the above-mentioned drawbacks would be beneficial. In particular, a refrigerator appliance with improved detection and notification of temperature changes would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a fresh food chamber and a freezer chamber; at least one sensor positioned within the cabinet, the at least one sensor being configured to monitor a temperature within the cabinet; and a controller operably coupled with the at least one sensor, the controller being configured to perform an operation. The operation may include determining the refrigerator appliance is operating according to a predetermined operating mode; receiving a temperature signal from the at least one sensor after determining the refrigerator appliance is operating according to the predetermined operating mode; determining that a value of the temperature signal is above a predetermined temperature threshold; determining that the temperature signal is received outside of a defrost phase during the predetermined operating mode; and emitting an alert in response to determining that the temperature signal is outside of the defrost phase and the value of the temperature signal is above the predetermined temperature threshold. The alert may include a value of the temperature signal and a date on which the temperature signal was received.

In another exemplary aspect of the present disclosure, a method of operating a refrigerator appliance is provided. The refrigerator appliance may include a cabinet defining a fresh food chamber and a freezer chamber, and at least one sensor positioned within the cabinet. The method may include determining the refrigerator appliance is operating according to a predetermined operating mode; receiving a temperature signal from the at least one sensor after determining the refrigerator appliance is operating according to the predetermined operating mode; determining that a value of the temperature signal is above a predetermined temperature threshold; determining that the temperature signal is received outside of a defrost phase during the predetermined operating mode; and emitting an alert in response to determining that the temperature signal is outside of the defrost phase and the value of the temperature signal is above the predetermined temperature threshold. The alert may include a value of the temperature signal and a date on which the temperature signal was received.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
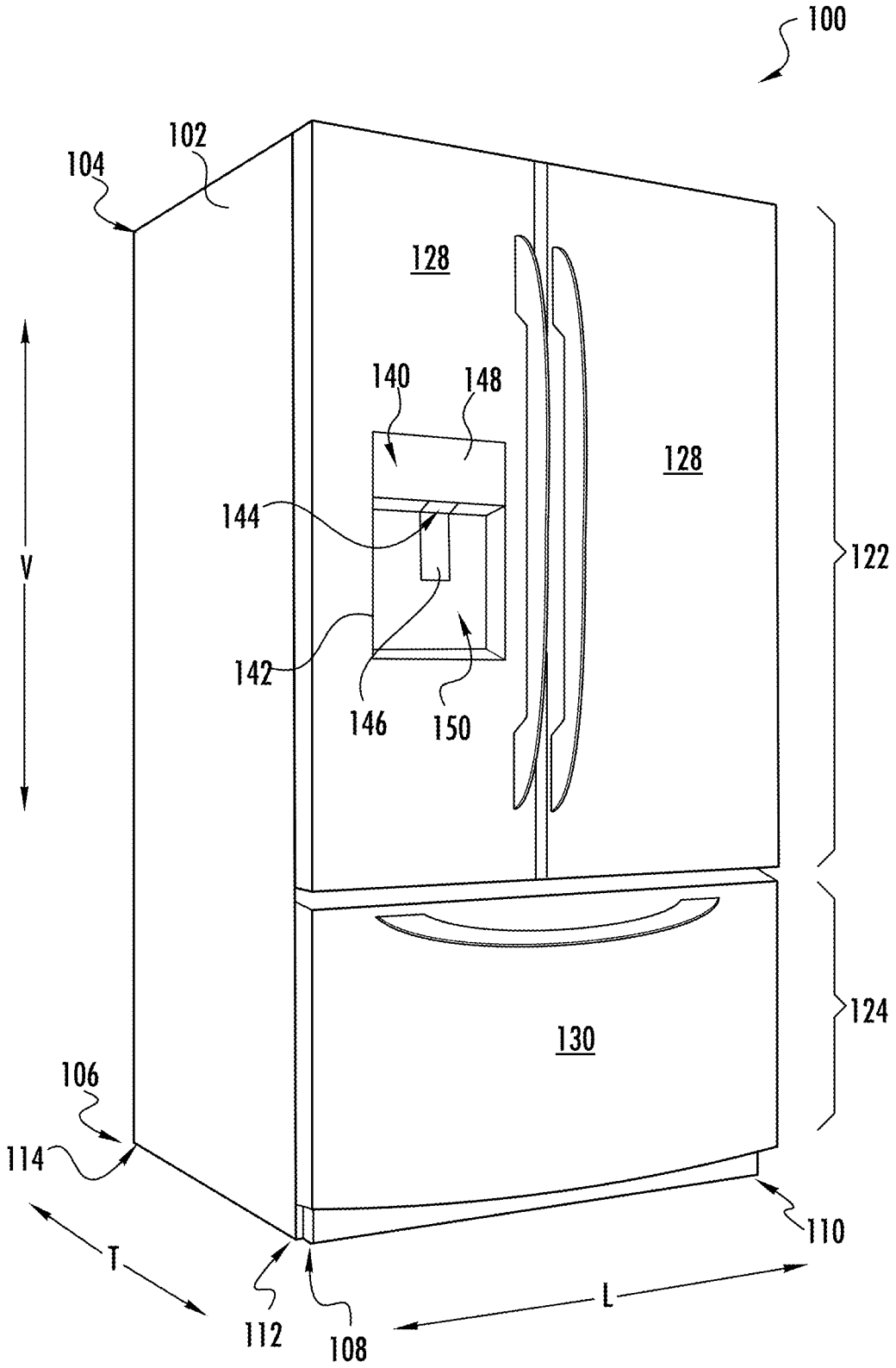
FIG. 1 provides a perspective view of a refrigerator appliance according to example embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
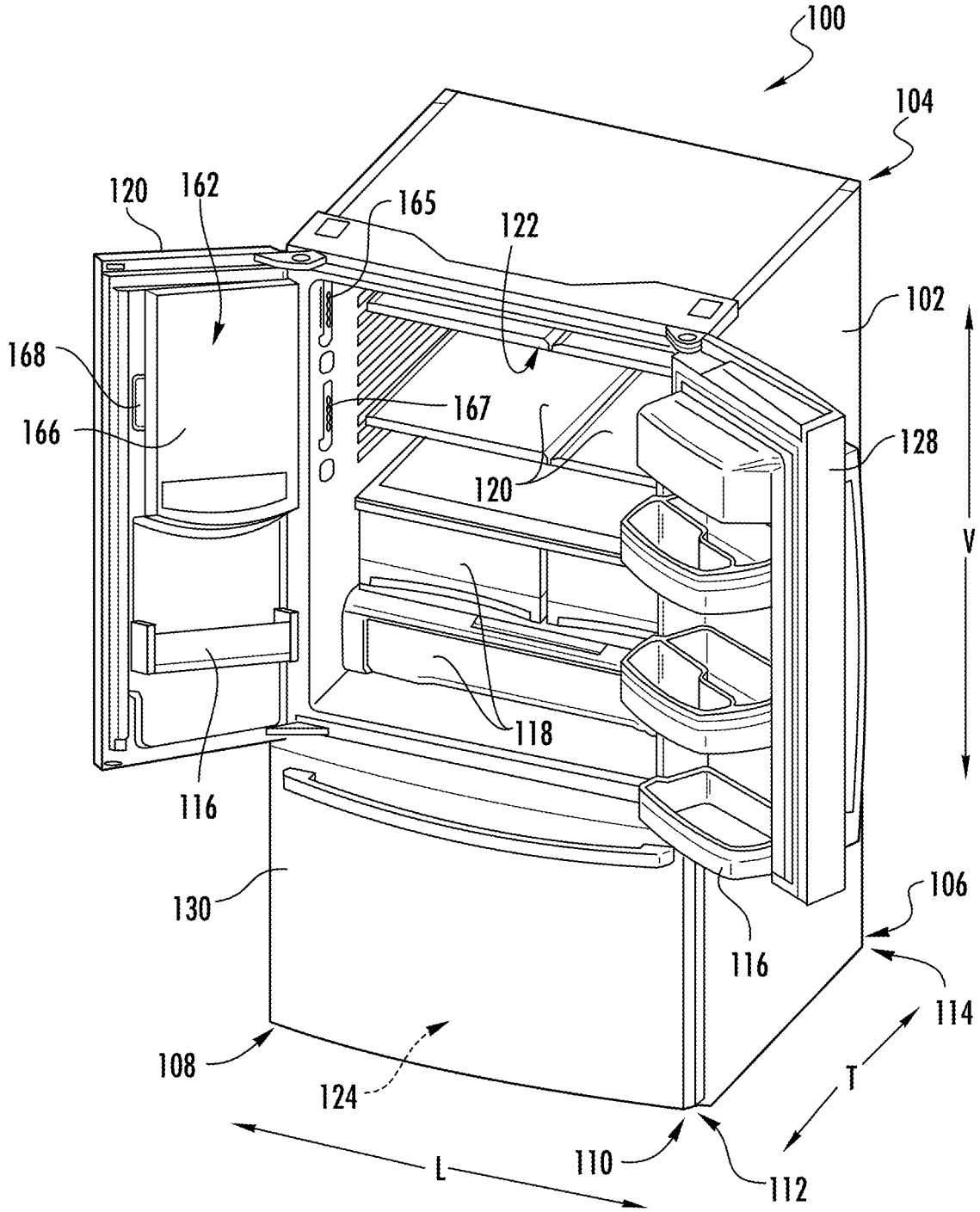
FIG. 2 provides a perspective view of a door of the example refrigerator appliance of FIG. 1.

Referring now to the figures, FIGS. 1 and 2 provide perspective views of a refrigerator appliance (e.g., refrigerator appliance 100) according to an exemplary embodiment of the present disclosure. As shown, refrigerator appliance 100 includes a cabinet or housing 102 that extends between a top 104 and a bottom 106 along a vertical direction V, between a first side 108 and a second side 110 along a lateral direction, and between a front 112 and a back 114 along a transverse direction T. Housing 102 may define one or more chilled chambers for receipt of food items for storage. In some embodiments, housing 102 defines fresh food chamber 122 positioned at or adjacent top 104 of the housing 102 and a freezer chamber 124 arranged at or adjacent bottom 106 of housing 102. As such, refrigerator appliance 100 may generally be referred to as a bottom mount refrigerator.

It is recognized, however, that the benefits of the present disclosure apply to other types and styles of refrigerator appliances such as, for example, a top mount refrigerator appliance, a side-by-side style refrigerator appliance or a standalone icemaker appliance. Consequently, the description set forth herein is for illustrative purposes only and is not intended to be limiting in any aspect to any particular refrigerator chamber configuration.

Refrigerator doors 128 may be rotatably hinged to an edge of housing 102 for selectively accessing fresh food chamber 122. In addition, a freezer door 130 may be arranged below refrigerator doors 128 for selectively accessing freezer chamber 124. Freezer door 130 may be coupled to a freezer drawer (not shown) slidably mounted within freezer chamber 124. Refrigerator doors 128 and freezer door 130 are shown in the closed configuration in FIG. 1.

In some embodiments, various storage components are mounted within fresh food chamber 122 to facilitate storage of food items therein, as would be understood. In particular, the storage components may include storage bins 116, drawers 118, and shelves 120 that are mounted within fresh food chamber 122. As such, storage bins 116, drawers 118, and shelves 120 are configured for receipt of food items (e.g., beverages or solid food items) and may assist with organizing such food items. As an example, drawers 118 may receive fresh food items (e.g., vegetables, fruits, or cheeses) and increase the useful life of such fresh food items.

In some embodiments, refrigerator appliance 100 also includes a dispensing assembly 140 for dispensing liquid water or ice. Dispensing assembly 140 may include a dispenser 142, for example, positioned on or mounted to an exterior portion of refrigerator appliance 100 (e.g., on one of doors 128). Moreover, as shown in FIG. 1, dispenser 142 may include a discharging outlet 144 for accessing ice and liquid water. Further, an actuating mechanism 146, shown as a paddle, may be mounted below discharging outlet 144 for operating dispenser 142. In alternative embodiments, any suitable actuating mechanism may be used to operate dispenser 142. A user interface panel 148 may also be provided for controlling the mode of operation. For example, user interface panel 148 may include a plurality of user inputs (not labeled), such as a water dispensing button and an ice-dispensing button, for selecting a desired mode of operation such as crushed or non-crushed ice.

Still referring to FIG. 1, discharging outlet 144 and actuating mechanism 146 may be an external part of dispenser 142 and may be mounted in a dispenser recess 150. Dispenser recess 150 may be positioned at a predetermined elevation convenient for a user to access ice or water and enabling the user to access ice without the need to bend-over and without the need to open doors 128. In additional embodiments, dispenser recess 150 is positioned at a level that approximates the chest level of a user.

In further embodiments, as shown in FIG. 2, refrigerator appliance 100 may include a sub-compartment 162 defined on refrigerator door 128. Sub-compartment 162 may be referred to as an "icebox." Further, as shown, sub-compartment 162 extends into fresh food chamber 122 when refrigerator door 128 is in the closed position. Although sub-compartment 162 is shown in door 128, additional or alterative embodiments may include sub-compartment 162 fixed within fresh food chamber 122. In an embodiment, an ice maker and/or an ice storage bin (not shown) may be positioned or disposed within sub-compartment 162. Accordingly, during use, ice may be supplied to dispenser recess 150 (FIG. 1) from the ice making assembly or ice storage bin in sub-compartment 162 on a back side of refrigerator door 128.

In additional or alternative embodiments, chilled air from a sealed system (not shown) of refrigerator appliance 100 may be directed into components within sub-compartment 162. For instance, sub-compartment 162 may receive cooling air from a chilled air supply duct 165 and a chilled air return duct 167 (FIG. 2) disposed on a side portion of cabinet 102 of refrigerator appliance 100. In this manner, supply duct 165 and return duct 167 may recirculate chilled air from a suitable sealed cooling system through sub-compartment 162.

In optional embodiments, as shown in FIG. 2, an access door 166 may be hinged to refrigerator door 128. Thus, access door 166 may permit selective access to sub-compartment 162. Any manner of suitable latch 168 may be configured with sub-compartment 162 to maintain access door 166 in a closed position. As an example, latch 168 may be actuated by a user in order to open access door 166 to provide access into sub-compartment 162. Access door 166 may also assist with insulating sub-compartment 162 (e.g., by thermally isolating or insulating sub-compartment 162 from fresh food chamber 122). It is noted that although access door 166 is illustrated in exemplary embodiments, alternative embodiments may be free of any separate access door.

Figure 3:
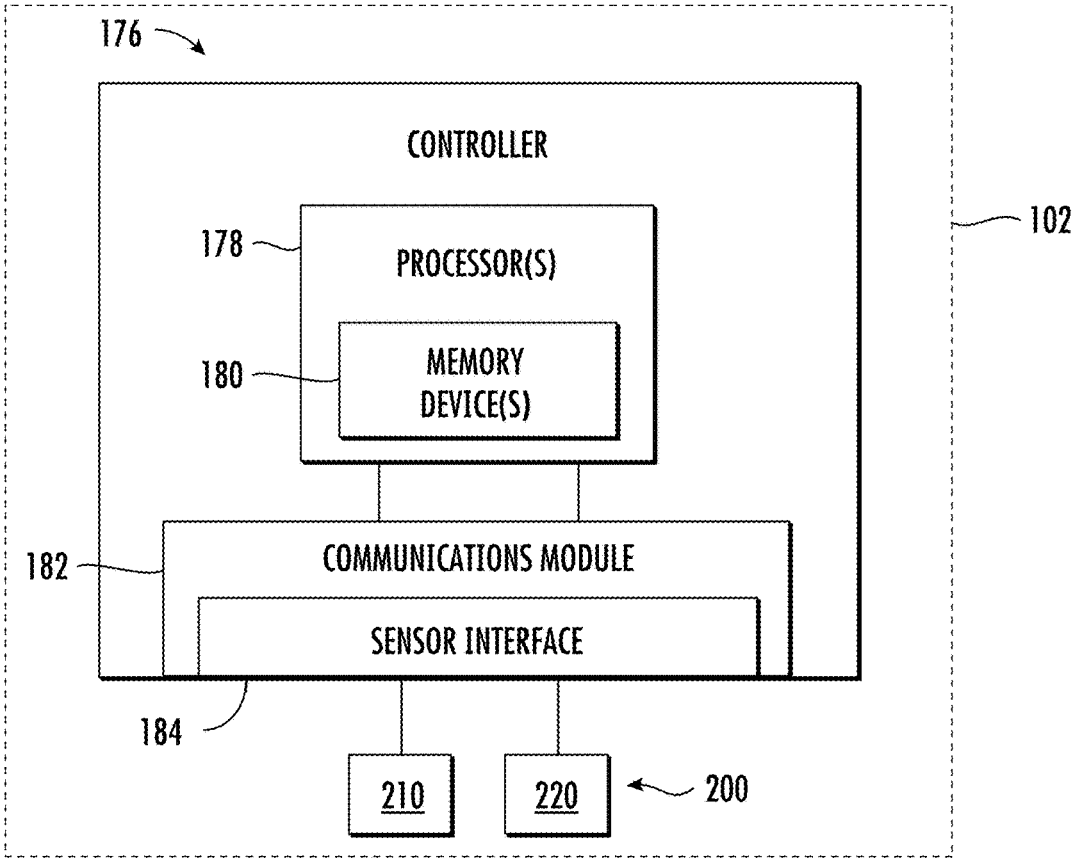
FIG. 3 provides a block diagram of one embodiment of a controller of a refrigerator appliance according to example embodiments of the present disclosure.

Referring particularly to FIG. 3, operation of refrigerator appliance 100 may generally be controlled by a processing device or controller 176. Controller 176 may, for example, be operatively coupled to control panel 148 for user manipulation to select features and operations of refrigerator appliance 100, such as temperature set points. Thus, controller 176 may operate various components of refrigerator appliance 100 to execute selected system cycles, processes, and/or features. In exemplary embodiments, controller 176 is in operative communication (e.g., electrical or wireless communication) with each of the chambers or compartments therein, for example, to regulate temperature as described herein.

More specifically, as shown in FIG. 3, a block diagram of one embodiment of suitable components that may be included within controller 176 in accordance with example aspects of the present disclosure is illustrated. As shown, controller 176 may include one or more processor(s) 178, computer, or other suitable processing unit and associated memory device(s) 180 that may include suitable computer-readable instructions that, when implemented, configure the controller to perform various different functions, such as receiving, transmitting and/or executing signals (e.g., performing the methods, steps, calculations and the like disclosed herein).

As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, memory device(s) 180 may generally include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements.

Such memory device(s) 180 may generally be configured to store suitable computer-readable instructions that, when implemented by processor(s) 178, configure the controller to perform various functions as described herein. Additionally, controller 176 may also include a communications module 182 to facilitate communications between the controller and the various components of refrigerator appliance 100. An interface can include one or more circuits, terminals, pins, contacts, conductors, or other components for sending and receiving control signals. Moreover, controller 176 may include a sensor interface 184 (e.g., one or more analog-to-digital converters) to permit signals transmitted from temperature probe(s) 210 described herein to be converted into signals that can be understood and processed by processor(s) 178.

As mentioned, refrigerator appliance 100 may include at least one sensor 200. The at least one sensor 200 may be positioned within cabinet 102 of appliance 100. For instance, the at least one sensor 200 may include a first temperature sensor or probe 210 and a second temperature sensor or probe 220. First temperature sensor 210 may be positioned within fresh food chamber or compartment 122 and second temperature sensor 220 may be positioned within freezer chamber or compartment 124. Thus, as would be understood, each of first temperature sensor 210 and second temperature sensor 220 may be configured to sense, measure, monitor, or otherwise determine a temperature within each of fresh food chamber 122 and freezer chamber 124, respectively. Additionally or alternatively, three or more sensors may be included as certain embodiments warrant, such as for additional chambers or compartments (e.g., an ice storage compartment, an ice maker, a beverage compartment, a drawer, etc.).

As used herein, "temperature sensor" or the equivalent is intended to refer to any suitable type of temperature measuring system or device positioned at any suitable location for measuring the desired temperature. Thus, for example, first temperature sensor 210 or second temperature sensor 220 may be or include any suitable type of temperature sensor, such as a thermistor, a thermocouple, a resistance temperature detector, a semiconductor-based integrated circuit temperature sensor, etc. In addition, first temperature sensor 210 or second temperature sensor 220 may be positioned at any suitable location and may output a signal, such as a voltage, to a controller (e.g., controller 176) that is proportional to or indicative of the temperature being measured. Although exemplary positioning of temperature sensors is described herein, it should be appreciated that appliance 100 may include any other suitable number, type, and position of temperature or other sensors according to alternative embodiments.

Figure 4:
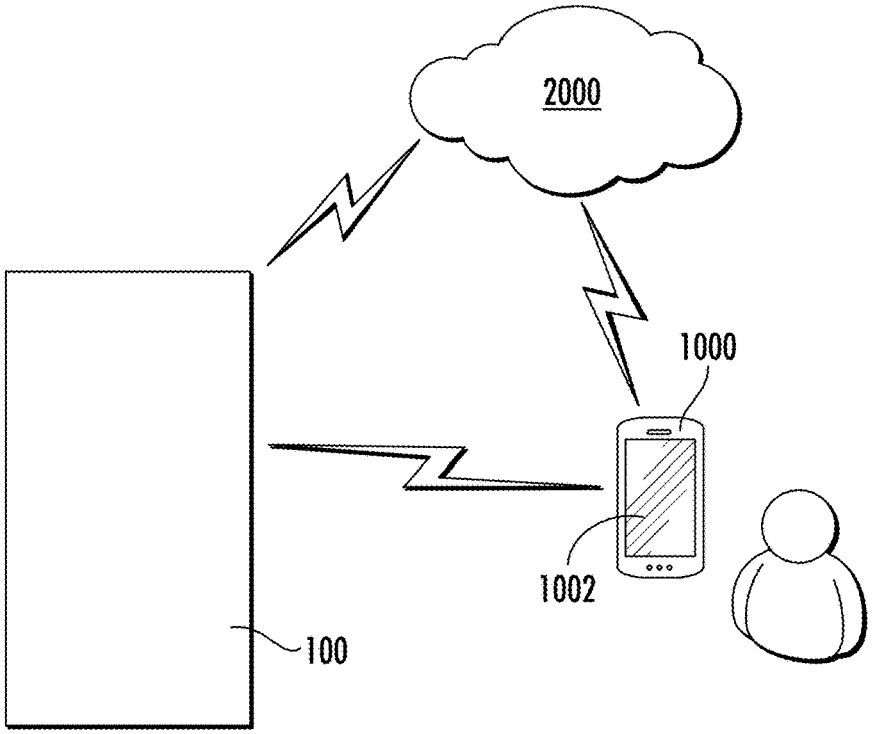
FIG. 4 provides a schematic illustrating a network connection between the refrigerator appliance of FIG. 1, a remote device, and a remote network.

FIG. 4 schematically illustrates refrigerator appliance 100 communicating with a remote user interface device 1000. Also shown (but not numbered) in FIG. 4 is a user such as may interact with the remote user interface device 1000, e.g., via a user interface 1002 of the remote user interface such as a touchscreen in the illustrated embodiment. For example, the remote user interface device 1000 may be a device such as a cell phone, smart phone, smart assistant, or any similar device in operative communication with controller 176 via a wireless connection. As shown in FIG. 4, refrigerator appliance 100, and in particular, controller 176 thereof, may be configured to communicate with a separate device external to appliance 100, such as a communications device or other remote user interface device 1000. Remote user interface device 1000 may be a laptop computer, smartphone, tablet, personal computer, wearable device, smart home system (such as a smart assistant speaker), or various other suitable devices. Refrigerator appliance 100 may include a network communication module, e.g., a wireless communication module, for communicating with the remote user interface device 1000. In various embodiments, a network communication module may include a network interface such that controller 176 of refrigerator appliance 100 can connect to and communicate over one or more networks with one or more network nodes. A network communication module may also include one or more transmitting, receiving, or transceiving components for transmitting/receiving communications with other devices communicatively coupled with refrigerator appliance 100. The network communication module may be in communication with, e.g., coupled or connected to, controller 176 to transmit signals to and receive signals from controller 176.

As schematically illustrated in FIG. 4, refrigerator appliance 100 may be configured to communicate with the remote user interface device 1000 either directly or through a network 2000 (e.g., a smart home network). Thus, in various embodiments, refrigerator appliance 100 and remote user interface 1000 may be configured to communicate wirelessly with each other or with network 2000. Network 2000 may be or include various possible communication connections and interfaces, e.g., such as Zigbee, BLUETOOTH®, WI-FI®, or any other suitable communication connection. The remote user interface device 1000 may include a memory for storing and retrieving programming instructions. For example, the remote user interface device 1000 may be a smartphone operable to store and run applications, also known as "apps," and may include a remote user interface provided as a smartphone app. Additionally or alternatively, multiple remote user interface devices 1000 may be connected with refrigerator appliance 100. For instance, one or more smart phones, one or more smart assistant devices (smart speakers), or the like may be simultaneously connected with refrigerator appliance 100 (e.g., through network 2000).

Figure 5:
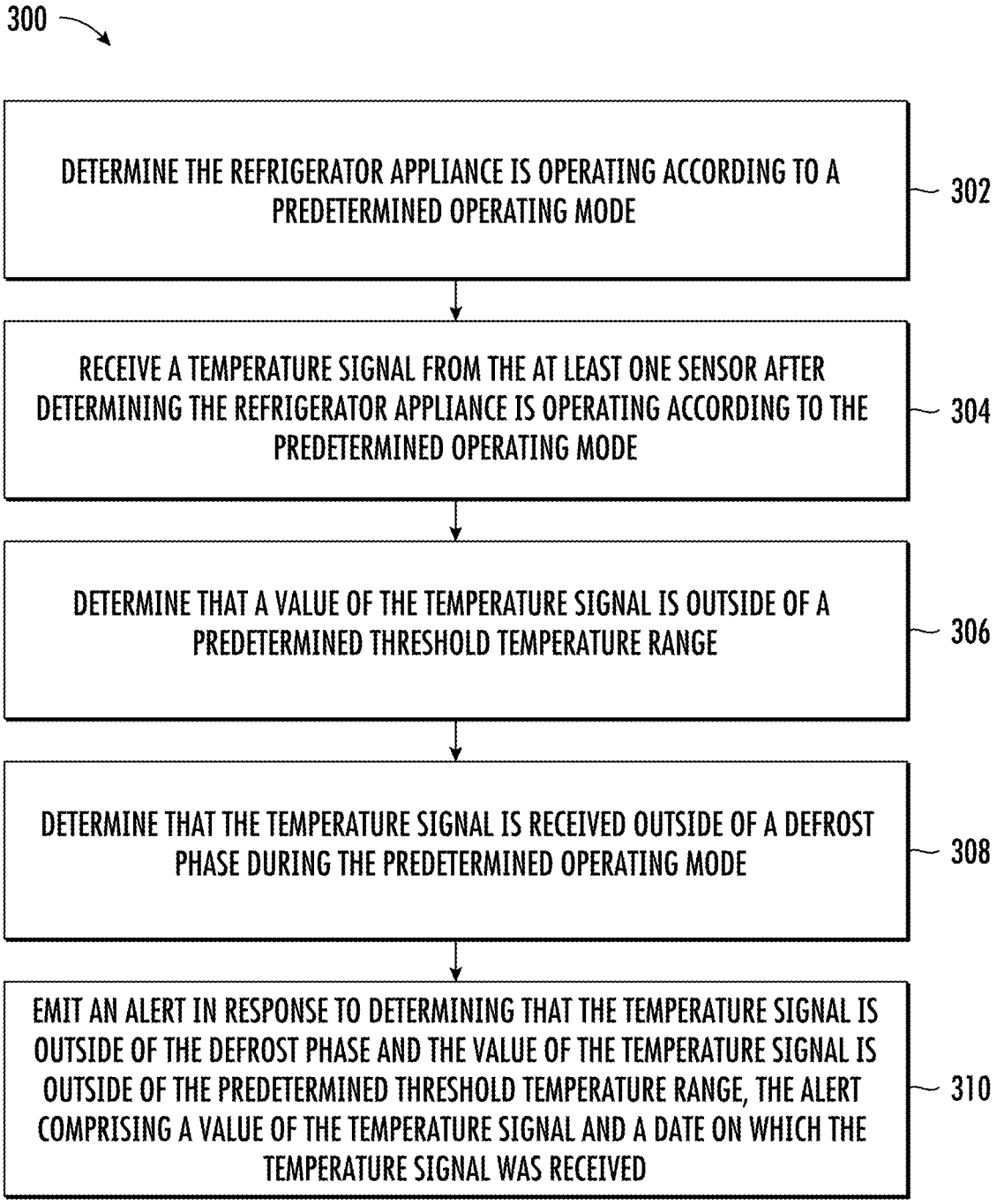
FIG. 5 provides a flow chart illustrating a method of operating a refrigerator appliance according to example embodiments of the present disclosure.

Now that the general descriptions of an exemplary appliance have been described in detail, a method 300 of operating an appliance (e.g., refrigerator appliance 100) will be described in detail. Although the discussion below refers to the exemplary method 300 of operating refrigerator appliance 100, one skilled in the art will appreciate that the exemplary method 300 is applicable to any suitable domestic appliance capable of performing a cooling operation (e.g., such as a freezer, an icemaker, etc.). In exemplary embodiments, the various method steps as disclosed herein may be performed by controller 176 and/or a separate, dedicated controller. FIG. 5 provides a flow chart illustrating a method of operating a refrigerator appliance. Hereinafter, method 300 will be described with specific reference to FIG. 5.

At step 302, method 300 may include determining the refrigerator appliance is operating according to a predetermined operating mode. For instance, a controller (e.g., controller 176) may determine that the appliance (e.g., refrigerator appliance 100) has been placed into a specific operating mode. A user may adjust one or more control programs or operational parameters of the appliance according to a requested mode. According to at least some embodiments, the predetermined operating mode is a vacation mode. The vacation mode may be indicative of an extended period of time for which the appliance may be idle, unused, or otherwise unmanipulated. Accordingly, the vacation mode may assume that doors (e.g., refrigerator doors 128, freezer door 130, etc.) may not be opened while the appliance is in the predetermined (vacation) mode. Thus, during the predetermined (vacation) mode, one or more of the doors of the appliance are maintained in the closed position, such that chambers (e.g., fresh food chamber 122, freezer chamber 124) are sealed.

As mentioned above, the appliance may be remotely connected with a network (e.g., cloud) with which information may be shared regarding operational parameters of the appliance. For instance, the appliance may periodically send signals to the cloud or remote network including, e.g., temperature signals, power signals, alerts, images, or the like. In some instances, method 300 may include detecting a loss of communication between the appliance (e.g., refrigerator appliance) and the remote network after determining the refrigerator is in the predetermined operating mode (vacation mode). The remote network (e.g., cloud) may determine that no signals are being received from the appliance when one or more sampling events are missed (e.g., relating to information sent from the appliance to the remote network).

Method 300 may thus further include determining a duration of the loss of communication between the appliance and the remote network. For instance, the remote network may resume a connection with the appliance after a predetermined down time or dark time. After resuming the connection, method 300 may calculate, estimate, or otherwise determine the length of the down time. The length or duration of the loss of communication (down time) may be stored, e.g., temporarily within the remote network or on the appliance, such as within a memory (e.g., memory device 180). Additionally or alternatively, certain information (e.g., metadata) may be stored relating to the down time, such as a day, month, year, time of day, or the like. The data and metadata may be packaged together into a notification or alert, described below.

At step 304, method 300 may include receiving a temperature signal from the at least one sensor after determining the refrigerator appliance is operating according to the predetermine operating mode. In detail, after the appliance is confirmed to be operating according to the predetermined mode (e.g., vacation mode), the at least one sensor (e.g., first temperature sensor 210, second temperature sensor 220) may measure the temperature within one of the chambers (e.g., fresh food chamber 122, freezer chamber 124, etc.) at predetermined intervals. The predetermined intervals may be set according to a schedule. For instance, the at least one sensor may send temperature signals at sampling events or time frames that are spaced apart (e.g., equally). Additionally or alternatively, the at least one sensor may be transmit the sensed temperature according to a predetermined trigger.

According to some embodiments, method 300 may include determining that a predetermined length of time has elapsed since a most recent defrost phase. For instance, after receiving the temperature signal, method 300 may compare the time at which the temperature signal was obtained against a defrost phase. In detail, the appliance may regularly perform defrost phases or operations to remove frost buildup from certain parts of the appliance (e.g., evaporator coils, sidewalls, etc.). As would be understood, during the defrost phases, a temperature within the cabinet (e.g., within the fresh food chamber or the freezer chamber) may temporarily increase. Accordingly, temperature signals obtained within the predetermined length of time since a most recent defrost phase may be ignored or flagged as an anticipated temperature rise.

Additionally or alternatively, as mentioned above, method 300 may determine that the appliance has been disconnected (e.g., remotely) from the remote network for a certain length of time. Upon reestablishing the connection, the temperature signal may be obtained and transmitted to the controller (e.g., either on board the appliance or at the remote network). The temperature signal may be analyzed within a predetermined time frame from reestablishing the connection.

At step 306, method 300 may include determining that the temperature signal is above a predetermined temperature threshold. In detail, while the appliance is operating according to the predetermined operation mode (e.g., vacation mode), temperature fluctuations may be predictable due to the doors remaining in the closed position. Accordingly, abnormally high temperatures may be flagged. Each temperature signal obtained by the at least one sensor and transmitted to the controller may be analyzed against the predetermined temperature threshold. As mentioned above, at step 308, method 300 may include determining that the temperature signal is received outside of a defrost phase. Accordingly, those temperature signals at or near the most recent defrost period (e.g., within the predetermined length of time) may be ignored as anticipated and within a normal operating range. Any temperature signal above the predetermined temperature threshold and outside of the defrost phase may be flagged and stored (e.g., within the memory).

At step 310, method 300 may include emitting an alert in response to determining that the temperature signal is outside of the defrost phase and the value of the temperature signal is above the predetermined temperature threshold. The alert may include the value of the temperature signal (e.g., in degrees Fahrenheit, degrees Celsius, etc.) and a date on which the temperature signal was received or obtained. As mentioned above, the appliance may remain in the predetermined operating (vacation) mode for an extended period of time, such as days, weeks, months, etc. The alert may thus include a timestamp of the temperature signal along with the value. The alert (or notification) may be emitted to one or more communications devices. For instance, the alert may be emitted or transmitted to a user interface of the appliance (e.g., a display or display screen), a remote user device (e.g., mobile phone, smartphone, etc.), a connected smart appliance (e.g., smart speaker, kitchen hub, etc.), or the like. For instance, the alert may be presented to a user via a mobile app (e.g., a push notification), a text message, an email, or the like.

According to some instances, the alert may include the duration of the loss of communication between the appliance and the remote network (e.g., the down time). For instance, in the event the loss of communication or outage was detected or determined, the alert may include information related to the outage, including a date stamp, a length of time, and the temperature detected immediately after reestablishing communication. Further, the alert may include general information related to items within the appliance. For instance, the alert may include guidance, tips, or the like pertaining to temperatures at which certain food items may be considered spoiled, unhealthy, dangerous, or the like.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a fresh food chamber and a freezer chamber;

at least one sensor positioned within the cabinet, the at least one sensor being configured to monitor a temperature within the cabinet;

a user interface device configured to allow a user to set a predetermined operating mode, wherein the predetermined operating mode is a vacation mode during which one or more doors of the refrigerator appliance are maintained in a closed position to seal each of the fresh food chamber and the freezer chamber; and a controller operably coupled with the at least one sensor, the controller being configured to perform an operation in the predetermined operating mode, the operation comprising:

receiving a temperature signal from the at least one sensor after determining the refrigerator appliance is operating according to the predetermined operating mode;

determining that a value of the temperature signal is above a predetermined temperature threshold;

determining that the temperature signal is received outside of a defrost phase during the predetermined operating mode; and emitting an alert in response to determining that the temperature signal is outside of the defrost phase and the value of the temperature signal is above the predetermined temperature threshold, the alert comprising a value of the temperature signal and a date on which the temperature signal was received.

2. The refrigerator appliance of claim 1, further comprising:

a wireless communication module operably coupled with the controller, the wireless communication module being selectively in communication with a remote network.

3. The refrigerator appliance of claim 2, wherein the operation further comprises:

detecting a loss of communication between the refrigerator appliance and the remote network after determining the refrigerator appliance is in the predetermined operating mode; and determining a duration of the loss of communication between the refrigerator appliance and the remote network.

4. The refrigerator appliance of claim 3, wherein emitting the alert further comprises:

providing the duration of the loss of communication between the refrigerator appliance and the remote network.

5. The refrigerator appliance of claim 1, wherein the operation further comprises:

determining that a predetermined length of time has elapsed since a most recent defrost phase after receiving the temperature signal.

6. The refrigerator appliance of claim 1, wherein the at least one sensor comprises:

a first temperature sensor positioned within the fresh food chamber and configured to monitor a temperature within the fresh food chamber; and a second temperature sensor positioned within the freezer chamber and configured to monitor a temperature within the freezer chamber.

7. The refrigerator appliance of claim 1, wherein emitting the alert comprises:

displaying the alert on a user interface of the refrigerator appliance.

8. The refrigerator appliance of claim 1, wherein emitting the alert comprises:

transmitting the alert to a remote connected device.

9. A method of operating a refrigerator appliance in a predetermined operating mode, the refrigerator appliance comprising a cabinet defining a fresh food chamber and a freezer chamber, at least one sensor positioned within the cabinet, and a user interface device configured to allow a user to set the predetermined operating mode, wherein the predetermined operating mode is a vacation mode during which one or more doors of the refrigerator appliance are maintained in a closed position to seal each of the fresh food chamber and the freezer chamber, the method comprising:

receiving a temperature signal from the at least one sensor after determining the refrigerator appliance is operating according to the predetermined operating mode;

determining that a value of the temperature signal is above a predetermined temperature threshold;

determining that the temperature signal is received outside of a defrost phase during the predetermined operating mode; and emitting an alert in response to determining that the temperature signal is outside of the defrost phase and the value of the temperature signal is above the predetermined temperature threshold, the alert comprising a value of the temperature signal and a date on which the temperature signal was received.

10. The method of claim 9, wherein the refrigerator appliance further comprises:

a wireless communication module selectively in communication with a remote network.

11. The method of claim 10, further comprising:

detecting a loss of communication between the refrigerator appliance and the remote network after determining the refrigerator appliance is in the predetermined operating mode; and determining a duration of the loss of communication between the refrigerator appliance and the remote network.

12. The method of claim 11, wherein emitting the alert further comprises:

providing the duration of the loss of communication between the refrigerator appliance and the remote network.

13. The method of claim 9, further comprising:

determining that a predetermined length of time has elapsed since a most recent defrost phase after receiving the temperature signal.

14. The method of claim 9, wherein the at least one sensor comprises:

a first temperature sensor positioned within the fresh food chamber and configured to monitor a temperature within the fresh food chamber; and a second temperature sensor positioned within the freezer chamber and configured to monitor a temperature within the freezer chamber.

15. The method of claim 9, wherein emitting the alert comprises:

displaying the alert on a user interface of the refrigerator appliance.

16. The method of claim 9, wherein emitting the alert comprises:

transmitting the alert to a remote connected device.

* * * * *